United States Patent [19]

Torterotot

[11] Patent Number: 4,996,824

[45] Date of Patent: Mar. 5, 1991

[54] METHOD AND DEVICE FOR STERILIZING A PACKAGING INSTALLATION FOR FOOD AND PHARMACEUTICAL PRODUCTS

[75] Inventor: Roland Torterotot, Saint-Arnoult-en-Yvelines, France

[73] Assignee: ERCA Holding, Les Ulis Cedex, France

[21] Appl. No.: 437,837

[22] Filed: Nov. 17, 1989

[30] Foreign Application Priority Data

Nov. 18, 1988 [FR] France ..... 88 15042

[51] Int. Cl.[5] ..... B65B 47/00; B65B 55/10

[52] U.S. Cl. ..... 53/426; 53/167; 53/453; 53/559; 422/26

[58] Field of Search ..... 53/167, 425, 426, 453, 53/559; 422/26, 292, 302

[56] References Cited

U.S. PATENT DOCUMENTS

| | | | |
|---|---|---|---|
| 3,820,300 | 6/1974 | Reinecke et al. | 53/425 |
| 3,911,640 | 10/1975 | Rausing | 53/426 |
| 3,942,299 | 3/1976 | Bory | 53/425 |
| 4,165,594 | 8/1979 | Corbic | 53/453 |
| 4,287,702 | 9/1981 | Corbic | 53/425 |
| 4,444,674 | 5/1984 | Inada . | |
| 4,503,656 | 3/1985 | Hautemont | 53/425 X |
| 4,512,133 | 4/1985 | Torterotot | 53/426 X |
| 4,543,770 | 10/1985 | Walter et al. | 53/426 X |
| 4,627,221 | 12/1986 | Buchner | 53/425 |
| 4,805,378 | 2/1989 | Anderson | 53/426 |

FOREIGN PATENT DOCUMENTS

| | | |
|---|---|---|
| 2391112 | 12/1978 | France . |
| 2599711 | 12/1987 | France . |

*Primary Examiner*—Robert L. Spruill
*Assistant Examiner*—Linda B. Johnson
*Attorney, Agent, or Firm*—Dennison, Meserole, Pollack & Scheiner

[57] ABSTRACT

The invention concerns a method and device for sterilizing a packaging installation for food or pharmaceutical products. The sterilizing device comprises, on the one hand, at least one row of discharge tubes adapted to apply a heat-resistant sheet and obturating the base of a tunnel to be sterilized, against the lower end of the outlet tubulures of a metering/dispensing device, and on the other hand, at least one row of perforating members adapted to perforate the sheet and to create a passage therethrough for a sterilizing fluid while the discharge tubes and the outlet tubulures grip the heat-resistant sheet.

12 Claims, 4 Drawing Sheets

METHOD AND DEVICE FOR STERILIZING A PACKAGING INSTALLATION FOR FOOD AND PHARMACEUTICAL PRODUCTS

FIELD OF THE INVENTION

The present invention relates to a method for sterilizing an installation for the packaging of sterile food or pharmaceutical products in liquid, paste or powder form.

BACKGROUND OF THE INVENTION

In particular, the invention is directed to such sterilization in an installation of the type comprising a tunnel closed at both ends, and, from the upstream end towards the downstream end of which are provided: a heating station for heating a thermoplastic band held laterally by clamping members provided on a conveying system such as endless chains; a thermoforming station for forming containers from the thermoplastic band; a metering/dispensing device for the sterile product, the metering device having at least one row of outlet tubulures penetrating into the tunnel; a container closing and sealing station preferably provided downstream of the tunnel; as well as supply units supplying sterile gas under pressure, issuing at several locations in the tunnel, of which the base is normally obturated by the thermoplastic band.

In a known method for sterilization of such an installation the base of the tunnel is temporarily obturated by a heat-resistant sheet, such as a sheet of metal such as aluminium, extending from the upstream end of the tunnel to beyond the downstream end thereof and joined to the thermoplastic band whose face turned towards the upper part of the tunnel is sterile and protected against pollution. A hot sterilizing fluid is then circulated separately through the tunnel and through the metering/dispensing device, and, after the sterilization of the tunnel and of the metering/dispensing device, the heat-resistant sheet and the thermoplastic band are moved forward until the whole base of the tunnel is formed by a length of said thermoplastic band while the tunnel continues to be scavenged with a sterile gas, having a pressure sufficient to allow it to escape through interstices existing between the lateral walls of the tunnel and the edges of the heat-resistant sheet or the thermoplastic hand projecting laterally from said tunnel.

This type of method, which is known for example from U.S. Pat. No. 4,165,594, requires a tunnel with walls, inside which a very hot fluid can be circulated, said fluid heating the inside face of the tunnel to a suitable sterilizing temperature. It is also possible to sterilize the inside face of the tunnel and all the elements issuing therein, with a very hot sterilizing gas, reaching for example a temperature of about 200° C. But since the sterilizing fluid cannot circulate through the lower part of the lower end of the metering/dispensing device opening out into the tunnel, said part can only be heated very slowly, hence involving very long sterilizing periods, especially as the tunnel and the metering/dispensing device then have to be cooled down to a temperature of about 30° to 35° C. before the metering and dispensing of the sterile product into the sterile containers of the sterile thermoplastic band can begin.

SUMMARY OF THE INVENTION

It is the object of the present invention to overcome the aforesaid drawbacks and to provide a method for sterilizing the tunnel and the metering/dispensing device which is sufficiently rapid and permits thermal sterilization and forced air cooling of the metering/dispensing device without any condensation of sterilizing fluid in said metering/dispensing device.

This object is reached, according to the invention, with a method consisting in the steps of: first placing the heat-resistant sheet on the base of the whole tunnel and against the edges of the walls defining it., sealingly applying said sheet against the edges of the outlet tubulures while, at the same time, sealingly applying at least one row of discharge tubes against the lower face of said heat-resistant sheet, the axes of said tubes coinciding with those of the outlet tubulures and their upper edges being in facing relationship to the lower edges of the outlet tubulures; piercing a hole in said heat-resistant sheet between each facing discharge tube and outlet tubulure; circulating a hot sterilizing fluid through the metering/dispensing device, said fluid being exhausted through the holes in the heat-resistant sheet and through the outlet tubulures while sterile air is circulated through the tunnel; optionally circulating a sterile cooling fluid through the metering/dispensing device and through the discharge tubes; lowering the row of discharge tubes to below the conveying level of the containers thermoformed in the thermoplastic band and feeding said heat-resistant sheet and thermoplastic band stepwise under the tunnel while maintaining inside the latter a slight excess pressure of sterile gas; and then, beginning the normal work cycle of the installation.

The foregoing allows for the use of a very hot or even an overheated fluid in order to bring the metering/dispensing device very quickly to a high sterilizing temperature, such as for example 160° C., after which the metering device can be rapidly cooled by circulating a sterilized refrigerating fluid therein, such as sterile air or water which will be exhausted through the holes made in the heat-resistant sheet. The heat-resistant sheet is advantageously a sheet of aluminium of about 50 $\mu$m thickness, clamped between the outlet tubulures of the metering device and the discharge tubes.

The present invention also relates to a device for sterilizing a tunnel and a metering/dispensing device forming part of an installation for packaging sterile products in liquid, paste or powder form, in the food and pharmaceutical field. Such installations may comprise, from the upstream end to the downstream end of a tunnel: a heating station for heating a thermoplastic band held laterally by clamping members provided on a conveying system such as endless chains; a thermoforming station for forming containers from the thermoplastic band., a sterile product metering/dispensing device, the metering device being provided with at least one row of outlet tubulures penetrating into the tunnel; a container closing and sealing station, preferably situated downstream of the tunnel, as well as supply units supplying a sterile gas under pressure, such as sterile air, which units issue at several locations in the tunnel, of which the base is either obturated normally by the thermoplastic band in such a way that there is only a very small gap or interstice between the sterile upper face of the thermoplastic band and the lower edge of the lateral walls of the tunnel which is also closed at the upstream and downstream ends, or temporarily obturated, during the sterilizing operation, by a heat-resistant sheet or length of band, for example of metal such as aluminium, and joined at its upstream end to the thermoplastic band the upper surface of which is protected against any pollution.

For sterilizing all the elements which are at least partly situated in the tunnel, such as the healing box of the heating station, the bell and the stamping die of the thermoforming station, the metering/dispensing device, etc., the heat-resistant sheet is placed so as to obturate the tunnel with the exception of a very small passageway between the lower edge of the lateral and end walls upstream and downstream of the tunnel and said heat-resisting sheet. A sterile gas such as air heated to an elevated temperature (such as 200° C.) and under a pressure exceeding that of the ambient atmosphere, is circulated inside the tunnel through the sterile gas supply units, while the heating box is brought to the same or to a higher temperature, and while a hot fluid, such as, in particular, overheated steam, is circulated in the stamping die and the bell of the thermoforming station as well as in the metering/dispensing device, while the outlet tubulures of said device are closed.

The disadvantage of this sterilizing system is that it requires quite a long sterilizing time due to the fact that, heretofore, it has been impossible to create a circulation of overheated steam in the zone of the outlet tubulures of the metering device, because condensates of water of which the temperature does not exceed 100° C. form therein. As a result, the rise in temperature of said outlet tubulures is slow and rarely exceeds the threshold of 100° C. within a reasonable period of time.

It is therefore a further object of the invention to overcome these drawbacks and to provide a sterilizing device for rapidly sterilizing the metering/dispensing device while sterilizing in the usual way the tunnel and other elements mentioned hereinabove.

This object is reached according to the invention with a sterilizing device associated to the metering/dispensing device comprising, beneath the heat-resistant sheet and the path of the thermoplastic band and of the thermoformed containers, and flush with the outlet tubulures of the metering/dispensing device, at least one row of discharge tubes, each discharge tube opening towards a corresponding outlet tubulure and having an upper end adapted to be applied against the lower end of a corresponding outlet tubulure, with interposition of the heat-resistant sheet, the edge of the opening of each discharge tube coaxially surrounding the axis of an outlet tubulures and coinciding with the lower opening thereof, as well as at least one row of piercing members movable perpendicularly to the plane of the heat-resistant sheet, each one of said members being placed coaxially to the joint axis of an outlet tubulure and of a corresponding discharge tube, and being guided either by the outlet tubulure, or by the discharge tube inside either one of which each member is adapted to retract.

Owing to this disposition, it is also possible to create in the lower part of the metering/dispensing device an effective circulation of sterilizing fluid by making a hole in the heat-resistant sheet while the latter is clamped in high position between the outlet tubulures and the discharge tubes, thus rapidly raising the metering/dispensing device to a high sterilizing temperature, reaching for example about 160° C., while said fluid flows out of the outlet tubulures through the holes made in the heat-resistant sheet into the corresponding discharge tubes, and then to rapidly cool the metering device down to the normal working temperature.

One advantage of the device according to the invention resides in that the sterilization of the metering device is carried out while the inside face of the tunnel is sterilized with hot air reaching for example a temperature of 200° C.

When the sterilization of the metering/dispensing device is completed, the discharge tubes are lowered to a rest position in which their openings are situated beneath the path of the bottoms of the thermoformed containers. The heat-resistant sheet and the thermoplastic band can then be moved forward stepwise and the products packaging phase may begin. Naturally, during the sequence of these various operations, a pressure is maintained inside the tunnel in excess of the ambient atmospheric pressure, by feeding therein a sterile gas under a slight excess pressure which, after the tunnel sterilizing phase, is at ambient temperatures.

One notable factor is that the small holes made in the heat-resistant sheet, have a rather small cross-section, so that once the discharge tubes have been lowered, the quantity of sterile gas exhausting through said holes is not sufficient to remove the slight excess pressure prevailing inside the tunnel and preventing gases from flowing into the tunnel from the outside.

BRIEF DESCRIPTION OF THE DRAWINGS

The invention will be more readily understood on reading the following description of preferred embodiments with reference to the accompanying drawings, in which:

FIG. 6 is a partial elevational view similar to FIG. 1, showing the sealing station.

DETAILED DESCRIPTION OF THE INVENTION

Figure 1:
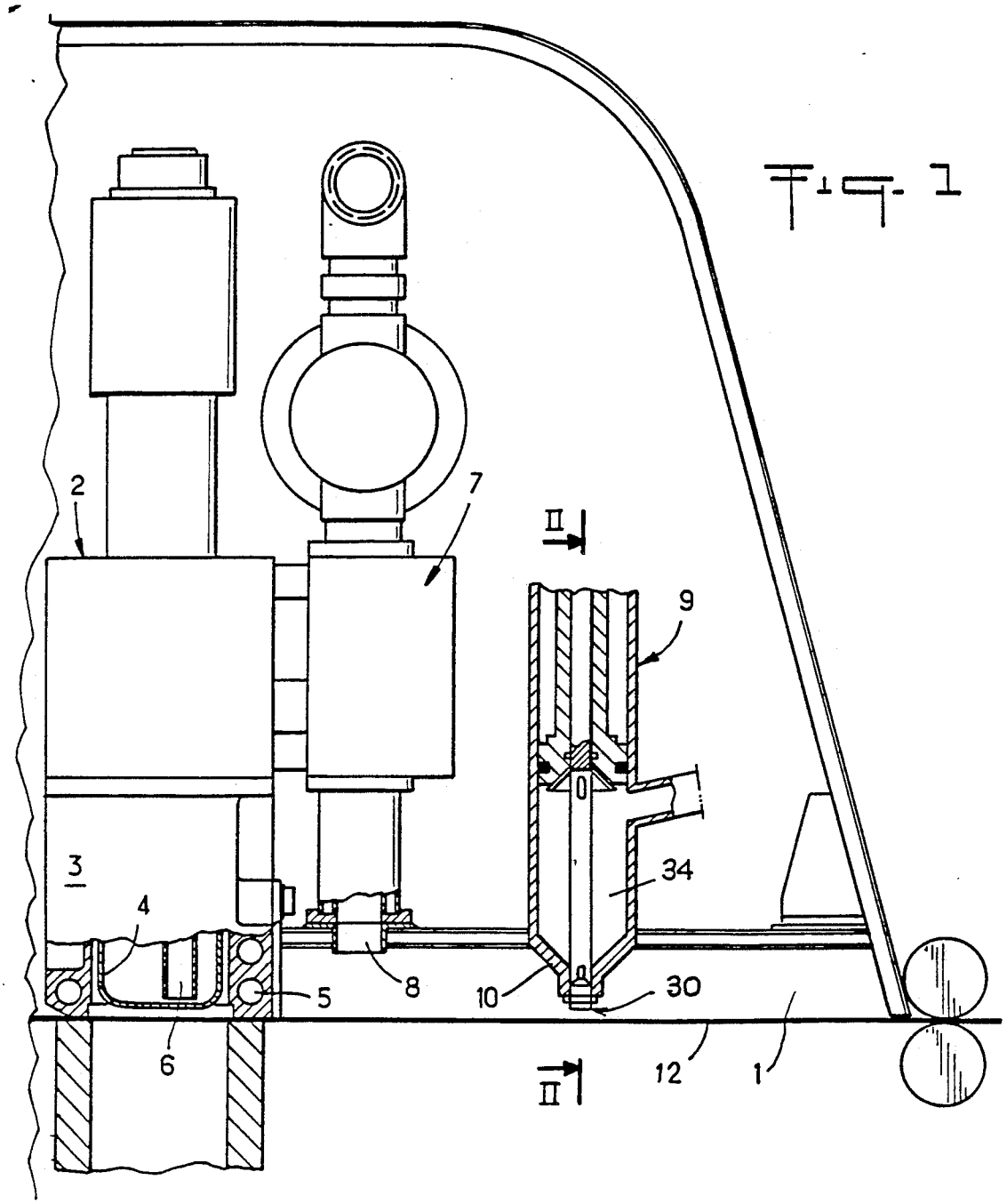
FIG. 1 is a partial elevational view of a vertical longitudinal section through a packaging installation.

Referring now to FIG. 1, this shows part of a conventional sterile packaging installation comprising a sterile tunnel 1 and, from the upstream end to the downstream end, a heating station, not shown, a thermoforming station 2 of which the forming bell 3 and the stamping die 4 are equipped with sterilizing means 5, 6 permitting the circulation of a sterilizing fluid, at least one supply unit 7 supplying a sterile gas such as sterile air flowing through its mouth 8, into, in particular, the upper part of the tunnel 1 and forming bell 3 of the thermoforming station 2, and a sterile product metering/dispensing device 9, whose lower part, and particularly its outlet tubulures 10, penetrate into the tunnel 1. The packaging installation further comprises, preferably downstream of the tunnel, a sealing station, not shown, for sealing the containers filled with products, and stepwise feeding means 11 such as endless chain, for the thermoplastic band which, except for a small gap opposite the lower edge 1*a* of the tunnel 1 closes entirely the base of said tunnel.

In order to sterilize the inside face of the tunnel 1 and all the parts of the various work stations communicating with the inside of said tunnel 1, the base of tunnel 1 is obturated with a heat-resistant sheet or length of band 12, particularly a sheet of aluminium or any other thin metal sheet, the upstream end of which is joined to the thermoplastic band 13 of which the upper face is sterile and protected against pollution by a protective strip until it enters the tunnel 1.

Metering/dispensing device 9, and more particularly the outlet tubulures 10 provided on its lower end penetrating into the tunnel 1, is coupled to a sterilizing device 14 provided under said metering/dispensing device 9. The tubulures are arranged in at least one transversal row so that the axes of said tubulures 10 are situated in a plane perpendicular to the stepwise feeding direction of the thermoplastic band 13 or of the aluminium sheet 12.

Metering/dispensing device 9 is a conventional metering device, either of the type with outlet tubulures which at the same time constitute ejection nozzles such as described in U.S. Pat. No. 4,165,594, or of the type with outlet tubulures equipped with movable ejection nozzles such as described in French Patent No. 86 08 138.

Figure 2:
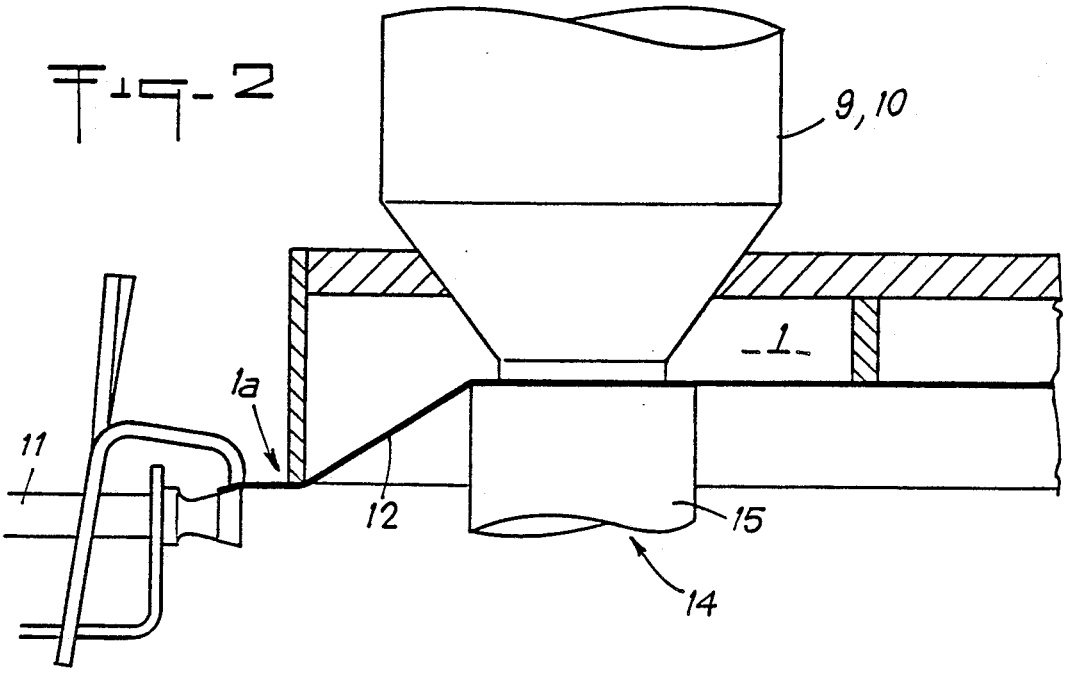
FIG. 2 is an elevational view of a cross-section along line II—II of FIG. 1.
Figure 3:
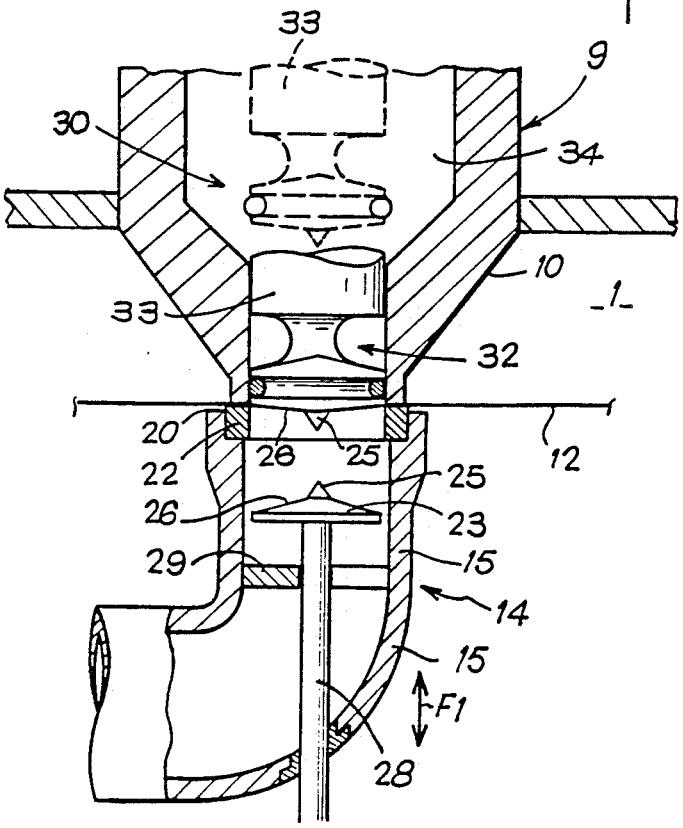
FIG. 3 is a partial elevational view through the sterilizing device of the metering/dispensing device.
Figure 5:
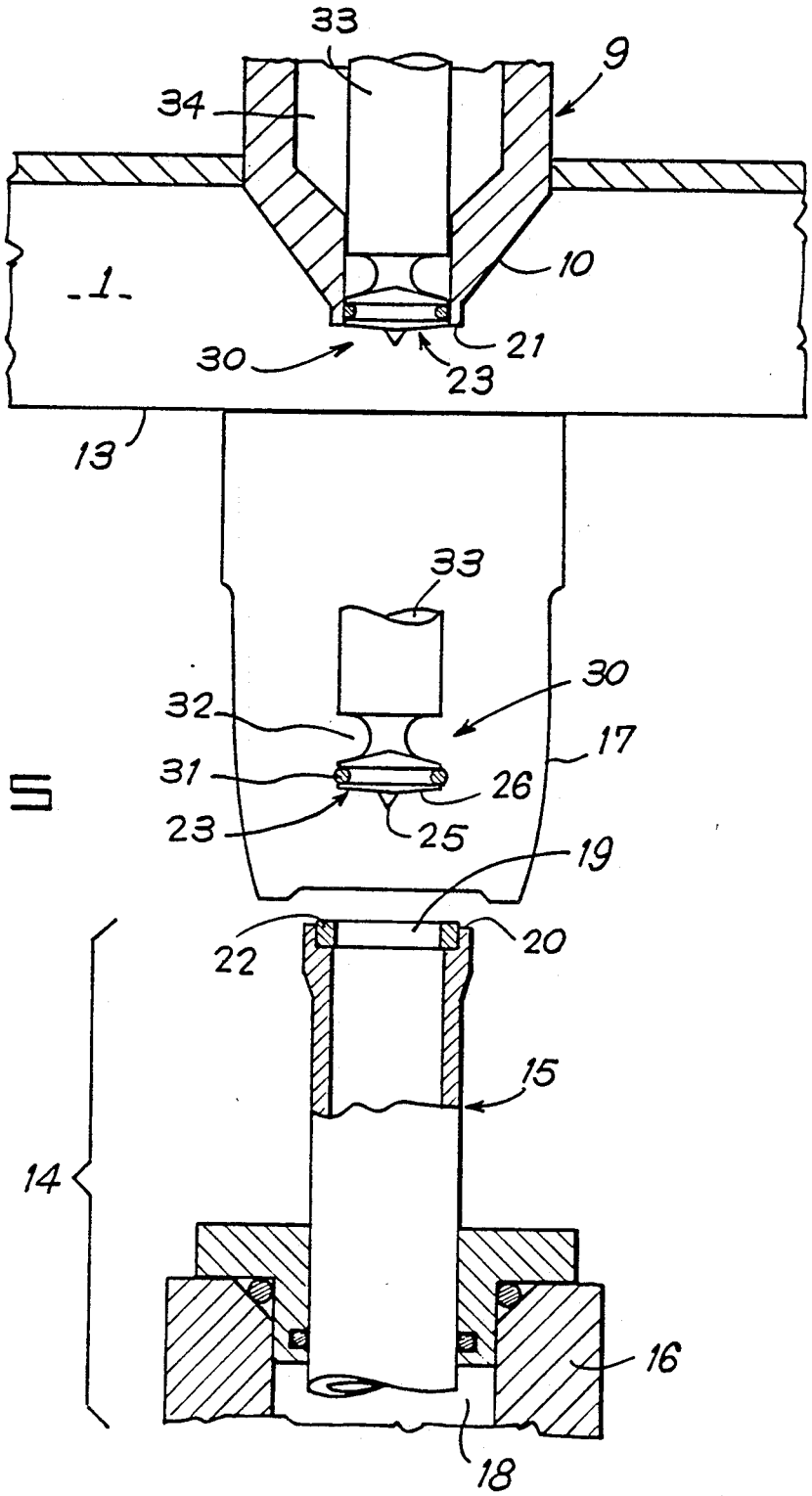
FIG. 5 is an elevational view through the sterilizing device in which the discharge tubes are in rest position.
Figure 5:
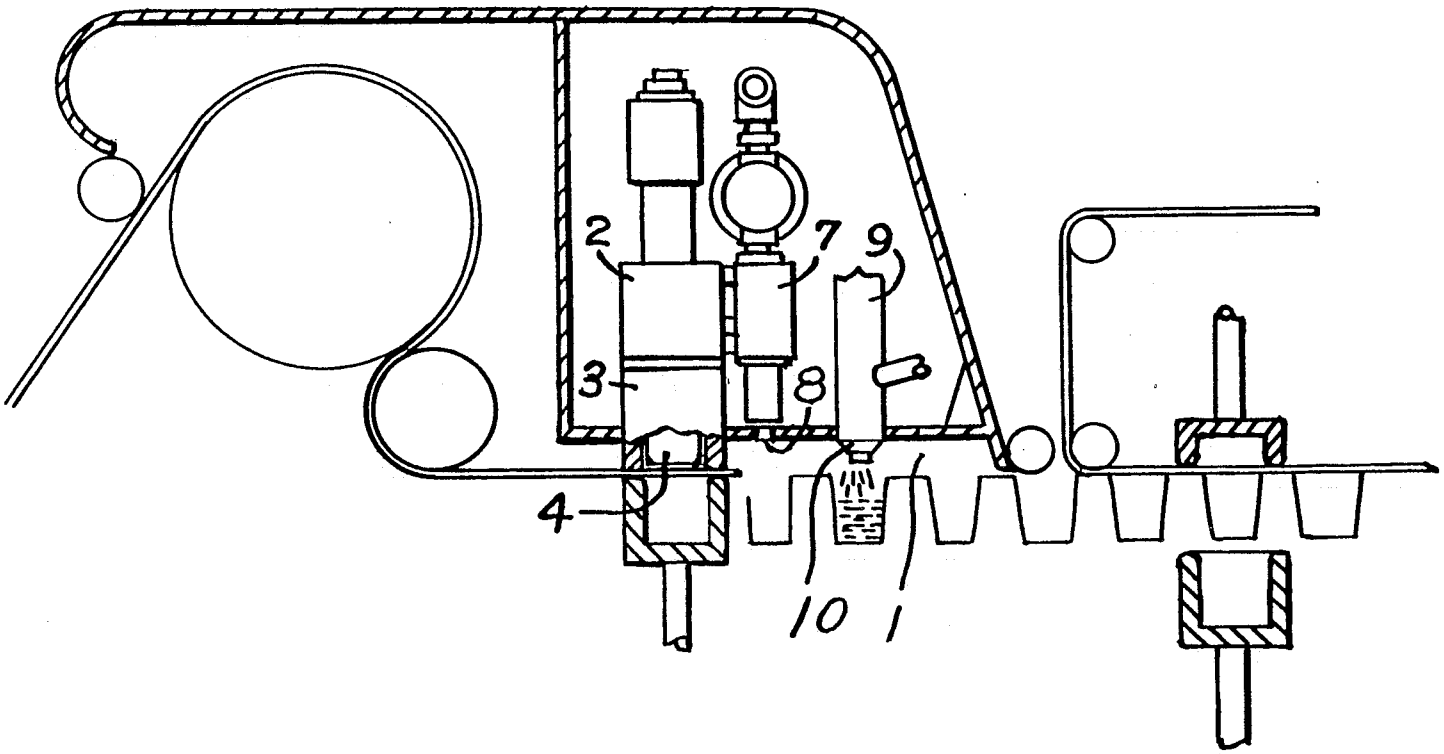

Sterilizing device 14 comprises at least one row of discharge tubes 15 mounted on a support 16 with which or with respect to which they can move vertically, as illustrated by arrows F1 in FIG. 3, between a high position shown in FIG. 2, in which they are sealingly applied against the lower face of aluminium sheet 12 and in which they in turn sealingly apply the upper face of said sheet 12 against the lower edge of the corresponding outlet tubulures 10, and a low position in which the upper end of the discharge tubes 15 is situated beneath the path of the bottoms of the containers 17 formed in the thermoplastic band 13, as illustrated in FIG. 5.

Each discharge tube 15 issues by its lower end into a transversal duct 18 connected to the tank of a closed circuit of sterilizing fluid, which circuit is also equipped with means for heating and delivering said fluid as well as means for cooling same. At the upper end of the discharge tube, the axis of which is in line with the axis of a corresponding outlet tubulure 10 of the metering device g, the opening 18 of tube 15 is defined by an annular rim 20 situated in facing relationship to the annular rim 21 of the corresponding outlet tubulure 10, but having a slightly greater radial width than the latter so as to project slightly on either side of annular rim 21 of said tubulure 10.

Furthermore, preferably within the face of rim 20 of discharge tube 15 is provided with a seal 22 projecting slightly upwards from the upper face of said rim 20.

Figure 4:
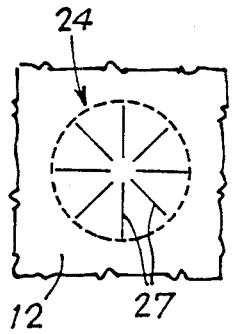
FIG. 4 is a plan view of one part of the heat-resistant sheet, which part is provided with a small passage hole.

Sterilizing device 14 further comprises a perforating member 23 adapted to perforate the aluminium sheet 12 when said sheet is sealingly gripped between the outlet tubulures 10 of the metering/dispensing device 9 and the discharge tubes 15 in raised position, making thus a small hole 24 at the location of each tube 15. Perforating member 23 is of general disc shape, the disc comprising on its face turned towards aluminium sheet 12, a small, projecting, sharp tip 25 onto which converge a plurality of radial ridges 26 which are slightly inclined rearwardly in the direction of the periphery of said disc. Owing to this particular design of the perforating member 23, the hole 24 made in aluminium sheet 12 is, as can be seen in FIG. 4, a very small central circular opening from which diverge radially in star form a number of straight notches 27. This form of hole has the advantage of letting through only a small flow of sterile gas, so that the excess pressure prevailing inside the tunnel 1 remains above the ambiant pressure prevailing outside the tunnel 1, when the discharge tubes 15 are returned to the low position.

A perforating member 23 may be placed inside each discharge tube 15. In such case, the perforating members are provided, on the surface thereof not facing the aluminium sheet 12, with a control rod 28, vertically guided in reciprocal vertical movement by a guide member 29, which may take the form of a star-shaped guide fixed in the discharge tube 15. The control rod 28 may extend through a sealed passage formed in an elbow comprising the discharge tube 15.

In this case, the sterilizing device 14 is more particularly coupled to a metering/dispensing device 9 the outlet tubulures 10 of which have no ejection nozzles.

When using a metering/dispensing device comprising ejection nozzles 30, the perforating member 23 will be advantageously provided on the lower end of each ejection nozzle 30 under the obturating member 31 and the dispensing apertures 32 of said nozzle 30, which latter comprises a hollow rod 33 through which the product to be dispensed reaches the dispensing apertures 32, and with which the lower end of the nozzle 30 is moved from the obturating position, as shown in block lines in FIGS. 3 and 5, either to retract inside the enlarged chamber 34 of the outlet tubulure 10 and allow free passage to the sterilizing fluid, as illustrated in dotted lines in FIG. 3, or to penetrate in a container 17 and fill it with the sterile product, as shown in FIG. 5.

The implementation of the sterilizing device and of the method of sterilizing the metering/dispensing device 9 will be readily understood from the foregoing description.

What is claimed is:

1. Method for sterilizing an installation for the packaging of sterile food or pharmaceutical products in liquid, paste or powder form, said installation comprising: a tunnel having a base, lateral walls, an upstream end and a downstream end, and being closed at both of said ends, said lateral walls having lower edges; and, from the upstream end towards the downstream end of said tunnel, a heating station for heating a thermoplastic band held laterally by clamping members provided on a conveying system and having a face turned toward said tunnel; a thermoforming station for forming containers from the thermoplastic band; a metering/dispensing device for said sterile product, the metering device having at least one row of outlet tubulures penetrating into the tunnel and having lower edges; a container closing and sealing station preferably provided downstream from the tunnel; as well as supply units supplying sterile gas under pressure, issuing at in several locations of the tunnel, the base of said tunnel being normally obturated by the thermoplastic band; said method consisting in temporarily obturating the base of the tunnel by a heat-resistant sheet, particularly of a metal such as aluminium, extending from the upstream end of the tunnel to beyond the downstream end thereof and being joined to the thermoplastic band, the face of which turned towards said tunnel is sterile and protected against pollution; in circulating a hot sterilizing fluid separately through the tunnel and through the metering/dispensing device; and, after the sterilization of the tunnel and of the metering/dispensing device, in moving the heat-resistant sheet and the thermoplastic hand forward until the whole base of the tunnel is formed by a length of said thermoplastic band while the tunnel is continuously scavenged with a sterile gas at a pressure slightly in excess of the ambient pressure whereby the sterile gas is capable of escaping through interstices existing between the lateral walls of the tunnel and the edges of the heat-resistant sheet or the thermoplastic band projecting laterally from said tunnel; said method being characterized in that it further comprises the steps of: placing the heat-resistant sheet on the base of the whole tunnel and against the lower edges of the lateral walls thereof; sealingly applying said sheet against the edges of the outlet tubulures while, at the same time, sealingly applying at least one row of discharge tubes having upper edges against the lower face of said heat-resistant sheet, the axes of said tubes coinciding with those of said outlet tubulures and the upper edges thereof being in facing relationship to the lower edges of the outlet tubulures; piercing a hole in said heat-resistant sheet between each facing discharge tube and outlet tubulure; circulating a hot sterilizing fluid through the metering/dispensing device, said fluid being exhausted through the holes in the heat-resistant sheet and through the outlet tubulures while sterile air is circulated through said tunnel; lowering the row of discharge tubes to a location beneath the conveying level of the containers thermoformed in the thermoplastic band; feeding said heat-resistant sheet and thermoplastic band stepwise under the tunnel while maintaining inside the latter a sterile gas under a pressure slightly in excess of the ambient pressure; and, then beginning the normal working cycle of the installation.

2. Sterilizing method as claimed in claim 1, wherein before lowering the row of discharge tubes, a sterile cooling fluid is circulate through the metering/dispensing device and the discharge tubes.

3. Device for sterilizing a tunnel and a metering/dispensing device forming part of an installation for packaging sterile products in liquid, paste or powder form, in the food and pharmaceutical field, said installation comprising, from the upstream end to the downstream end of a tunnel having a base, lateral walls, an upstream end provided with an entrance and a downstream end, said upstream end and said downstream end being closed, and said lateral walls having lower edges: a heating station for heating a thermoplastic band held laterally by clamping members provided on a conveying system and having a sterile upper face and moving along a path from upstream to downstream; a thermoforming station for forming containers from the thermoplastic band; a sterile product metering/dispensing device, the metering device being provided with at least one row of outlet tubulures penetrating into said tunnel and each having a lower end provided with an opening within which is disposed an ejection nozzle having a lower end; a container closing and sealing station, preferably situated downstream of the tunnel; as well as supply units supplying a sterile gas under pressure, such as sterile air, which units issue at several locations in said tunnel, the base of said tunnel being either obturated normally by said thermoplastic band whereby only a very small gap or interstice exists between said sterile upper face of said thermoplastic band and the lower edges of said lateral walls of the tunnel, or temporarily obturated by a heat-resistant sheet or length of band, such as of aluminium, disposed in a plane parallel to the path along which said thermoplastic band moves and having an upper face, and joined at it upstream end to the thermoplastic band, the upper face of which is protected against pollution until such time as the thermoplastic band reaches the entrance of said tunnel; wherein said device comprises, both beneath the heat-resistant sheet and the path of the thermoplastic band and of the containers thermoformed therein; and, flush with the outlet tubulures of the metering/dispensing device, at least one row of discharge tubes having an upper end with an opening having an edge open towards the outlet tubulures and adapted to be applied by the upper end thereof against the lower end of the outlet tubulures, with interposition of said heat-resistant sheet, the edge of the opening of each discharge tube surrounding coaxially the axis of an outlet tubulure and coinciding with the lower opening thereof, as well as at least one row of piercing members movable perpendicularly to the plane of the heat-resistant sheet, each one of said piercing members being placed coaxially to the joint axis of an outlet tubulure and of a corresponding discharge tube.

4. Sterilizing device as claimed in claim 3, wherein the piercing members are adapted to be guidedly retracted inside the outlet tubulures.

5. Sterilizing device as claimed in claim 3, wherein the piercing members are adapted to be guidedly retracted inside the discharge tubes.

6. Sterilizing device as claimed in claim 3, wherein the discharge tubes are vertically movable between a high position in which the discharge tubes are sealingly applied against the lower face of said heat-resistant sheet and, in turn apply the upper face of said sheet against the lower edge of the corresponding outlet tubulure, and a low position in which the upper end of the discharge tubes is situated under the path of the containers formed in the thermoplastic band.

7. Sterilizing device as claimed in claim 3, wherein each discharge tube issues by the lower end thereof into a transversal duct connected with a tank of a closed circuit of sterilizing fluid, which circuit is also provided with means for heating and delivering said fluid as well as with means for cooling said fluid.

8. Sterilizing device as claimed in claim 3, wherein the respective openings of the discharge tubes and of the outlet tubulures are defined by annular rims situated in mutually facing relationship, the annular rims of the discharge tubes having a radial width slightly greater than the radial width of the annular rims of said outlet tubulures, whereby the annular rims of the discharge tubes project radially slightly beyond the annular rims of the outlet tubulures.

9. Sterilizing device as claimed in claim 6, wherein the rim of the discharge tube is equipped with a seal projecting slightly upwardly towards the upper end of said rim.

10. Sterilizing device as claimed in claim 3, wherein the piercing members have the general shape of a disc having an upper face turned towards said heat-resistant sheet, said upper face comprising a small projecting sharp tip on which converge a number of radial ridges which are slightly inclined rearwardly in the direction of the periphery of the disc.

11. Sterilizing device as claimed in any one of claims 3, 5 or 10, wherein the piercing members, placed inside each discharge tube comprise a lower face turned away from said heat-resistant sheet and attached to a control rod guided vertically by a guiding member fixed in said tube.

12. Sterilizing device as claimed in any one of claims 3 or 4 wherein said piercing member is provided on the lower end of the ejection nozzles of the metering/dispensing device.

* * * * *